US008860654B2

(12) United States Patent
Yamazaki

(10) Patent No.: US 8,860,654 B2
(45) Date of Patent: Oct. 14, 2014

(54) ELECTROPHORETIC DISPLAY DEVICE, CONTROL CIRCUIT, ELECTRONIC APPARATUS, AND DRIVING METHOD FOR REDUCING IMAGE FLICKER

(75) Inventor: Katsunori Yamazaki, Matsumoto (JP)

(73) Assignee: Seiko Epson Corporation (JP)

( * ) Notice: Subject to any disclaimer, the term of this patent is extended or adjusted under 35 U.S.C. 154(b) by 536 days.

(21) Appl. No.: 13/094,095

(22) Filed: Apr. 26, 2011

(65) Prior Publication Data

US 2011/0267332 A1 Nov. 3, 2011

(30) Foreign Application Priority Data

Apr. 28, 2010 (JP) ..... 2010-103413

(51) Int. Cl.
*G09G 3/34* (2006.01)

(52) U.S. Cl.
CPC ..... *G09G 3/344* (2013.01); *G09G 2300/08* (2013.01); *G09G 2320/0257* (2013.01); *G09G 2310/06* (2013.01); *G09G 2320/0247* (2013.01)
USPC ..... 345/102

(58) Field of Classification Search
USPC ..... 345/107
See application file for complete search history.

(56) References Cited

U.S. PATENT DOCUMENTS

| | | | | |
|---|---|---|---|---|
| 2006/0202949 | A1 * | 9/2006 | Danner et al. | 345/107 |
| 2007/0139358 | A1 | 6/2007 | Sakamoto | |
| 2007/0188509 | A1 * | 8/2007 | Shigehiro et al. | 345/581 |
| 2007/0262949 | A1 * | 11/2007 | Zhou et al. | 345/107 |
| 2008/0117165 | A1 * | 5/2008 | Machida et al. | 345/107 |

FOREIGN PATENT DOCUMENTS

| | | | | |
|---|---|---|---|---|
| JP | 2004-163667 A * | 6/2004 | | G09G 3/20 |
| JP | 2007-163987 | 6/2007 | | |
| JP | 2008-158243 A * | 7/2008 | | G09G 3/34 |

* cited by examiner

*Primary Examiner* — Adam J Snyder
(74) *Attorney, Agent, or Firm* — Harness, Dickey & Pierce, P.L.C.

(57) ABSTRACT

Provided is an electrophoretic display device including: an electrophoretic panel which is provided with an electrophoretic element which includes a first electrode, a second electrode which faces the first electrode, and a charged particle arranged between the first electrode and the second electrode; and a control circuit which controls the electrophoretic panel. The control circuit controls a data voltage with a value which corresponds to the specified gradation of the electrophoretic element to be applied between the first electrode and the second electrode in a writing period, and controls a correction voltage which is the opposite polarity to the data voltage and is less than or equal to a predetermined threshold value to be applied between the first electrode and the second electrode in a correction period which is different from the writing period.

4 Claims, 9 Drawing Sheets

ELECTROPHORETIC DISPLAY DEVICE, CONTROL CIRCUIT, ELECTRONIC APPARATUS, AND DRIVING METHOD FOR REDUCING IMAGE FLICKER

CROSS-REFERENCE TO RELATED APPLICATION

This application is based on and claims priority from Japanese Patent Application No. 2010-103413, filed on Apr. 28, 2010, the contents of which are incorporated herein by reference.

BACKGROUND

1. Technical Field

The present invention relates to an electrophoretic display device, a control circuit, an electronic apparatus, and a driving method.

2. Related Art

When an electric field acts on a dispersion where fine particles are dispersed in a liquid, it is known that the fine particles move (migrate) within the liquid due to a Coulomb force. This phenomena is referred to as electrophoresis, and in recent years, electrophoretic display devices where desired information (images) is displayed using electrophoresis have attracted attention as a new display device. For example, in JP-A-2007-163987, there is disclosed an electrophoretic display device which is provided with a micro capsule-type electrophoretic element which includes a pixel electrode, an opposing electrode, and a microcapsule arranged between the pixel electrode and the opposing electrode. In the microcapsule, a solvent for dispersing electrophoretic particles in the microcapsule, a plurality of white particles, and a plurality of black particles are enclosed.

When there are problems with image unevenness such as so-called burn-in in the electrophoretic display device, there is a technique disclosed in JP-A-2007-163987 for preventing burn-in by making equal an applied voltage (voltage applied between the pixel electrode and the opposing electrode)×time and a reverse applied voltage (with the opposite polarity to the applied voltage)×time. In addition, in JP-A-2007-163987, image flickering is prevented by setting the reverse applied voltage to an intermediate voltage. For example, there is a method where the image flickering is alleviated by transferring the display in a manner such as black→dark gray→black compared to a case of transferring the display in a manner such as black→white→black.

However, in the technique disclosed in JP-A-2007-163987, since image flickering is visually recognized, there is a problem that the user is displeased.

SUMMARY

An advantage of some aspects of the invention is that an electrophoretic display device is provided which does not display image flickering and prevents image unevenness such as burn-in.

An electrophoretic display device according to an aspect of the invention is provided with an electrophoretic panel, which is provided with an electrophoretic element which includes a first electrode, a second electrode which faces the first electrode, and a charged particle arranged between the first electrode and the second electrode, and a control circuit which controls the electrophoretic panel, where the control circuit controls a data voltage with a value which corresponds to the specified gradation of the electrophoretic element to be applied between the first electrode and the second electrode in a writing period and controls a correction voltage which is the opposite polarity to the data voltage and is less than or equal to a predetermined threshold value to be applied between the first electrode and the second electrode in a correction period which is different from the writing period.

Here, that the correction voltage and the data voltage are "opposite polarities" from each other has a meaning that application directions of the voltages are in opposite directions from each other, and the direction of the electric charge which flows between the first electrode and the second electrode when the correction voltage is applied between the first electrode and the second electrode and the direction of the electric charge which flows between the first electrode and the second electrode when the data voltage is applied between the first electrode and the second electrode are opposite directions from each other.

In addition, in regard to the "predetermined threshold value", in a case where the voltage between the first electrode and the second electrode is equal to or less than the predetermined threshold value, it is sufficient if it is a value where the display state does not change and it is possible for the value to be set arbitrarily. In the case where the voltage between the first electrode and the second electrode is equal to or less than the predetermined threshold value, a state where the charged particle does not move is preferable, but it may be a state where the charged particle moves within a range where the display state does not change.

The invention was conceptualized as the correction voltage which is the opposite polarity to the data voltage and is less than or equal to a predetermined threshold value being applied between the first electrode and the second electrode in the correction period which is different from the writing period where the data voltage which corresponds to the specified gradation is written due to it being found that display unevenness such as burn-in and residual image in the electrophoretic display device is caused by a direct current component of an electric current which flows between the first electrode and the second electrode due to movement of an ion which is different from the charged particle and not a direct current component of an electric current which flows between the first electrode and the second electrode due to movement of the charged particle. According to the aspect, since it is possible to negate (cancel out) the direct current component of the electric current which flows due to the movement of an ion without changing the display state, there is an advantage in that it is possible to not display image flickering and to prevent image unevenness such as burn-in.

In an electrophoretic display device according to another aspect of the invention, the control circuit controls the electrophoretic panel so that the absolute value of a time integration value of the electric current which flows between the first electrode and the second electrode due to the movement of an ion which is different from the charged particle in the writing period and the absolute value of a time integration value of the electric current which flows between the first electrode and the second electrode due to the movement of the ion in the correction period are equal. According to the aspect, by making equal the absolute value of the time integration value of the electric current which flows between the first electrode and the second electrode due to the movement of the ion in the writing time and the absolute value of the time integration value of the electric current which flows between the first electrode and the second electrode due to the movement of the ion in an opposite direction to the writing period in the correction period, it is possible to make the direct current component of the electric current which flows due to the movement of the ion equal to zero. Accordingly, from the point of view of not displaying image flickering, the aspect described above is exceptionally effective.

The invention may be interpreted as an invention of a control circuit which controls the electrophoretic panel which includes the electrophoretic element. A control circuit according to an aspect of the invention controls an electrophoretic panel, which includes an electrophoretic element which has a first electrode, a second electrode which faces the first electrode, and a charged particle arranged between the first electrode and the second electrode, where a data voltage with a value which corresponds to the specified gradation of the electrophoretic element is controlled to be applied between the first electrode and the second electrode in a writing period and a correction voltage which is the opposite polarity to the data voltage and is less than or equal to a predetermined threshold value is controlled to be applied between the first electrode and the second electrode in a correction period after the writing period. The same effect as the electrophoretic display device according to the aspect of the invention can be obtained even with the control circuit above.

The electrophoretic display device according to the aspect of the invention is used in various types of electronic apparatuses. As an electronic apparatus according to still another aspect of the invention, an electronic paper, an electronic notebook, a wrist watch, a mobile phone, a portable audio device, or the like is exemplified.

Furthermore, the invention may be interpreted as a driving method of an electrophoretic element. A driving method of an electrophoretic element, which has a first electrode, a second electrode which faces the first electrode, and a charged particle arranged between the first electrode and the second electrode, according to an aspect of the invention includes applying a data voltage with a value which corresponds to the specified gradation of the electrophoretic element between the first electrode and the second electrode in a writing period, and applying a correction voltage which is the opposite polarity to the data voltage and is less than or equal to a predetermined threshold value between the first electrode and the second electrode in a correction period after the writing period. The same effect as the electrophoretic display device according to the aspect of the invention can be obtained even with the driving method above.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: First Embodiment

Figure 1:
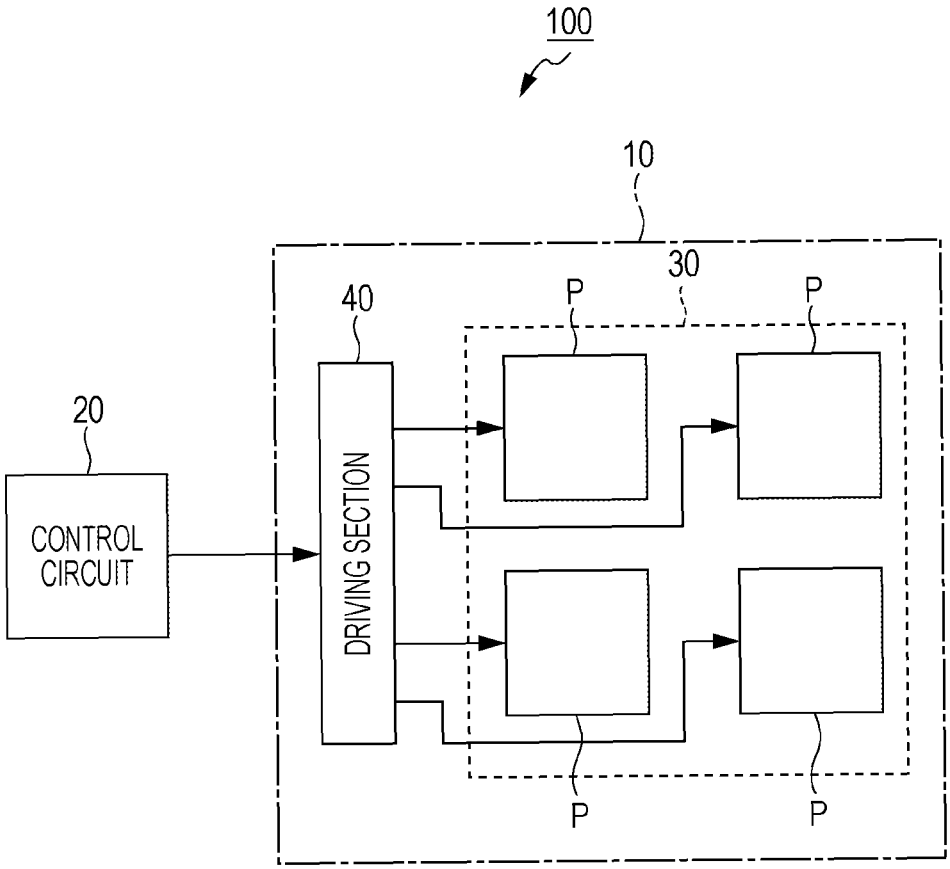
FIG. 1 is a diagram illustrating an outline configuration of an electrophoretic display device according to a first embodiment of the invention.

FIG. 1 is a block diagram illustrating an outline configuration of an electrophoretic display device 100 according to a first embodiment of the invention. As shown in FIG. 1, the electrophoretic display device 100 according to the embodiment is provided with an electrophoretic panel and a control circuit 20. The control circuit 20 controls the electrophoretic panel 10 based on image data and synchronization signals supplied from a high-level device.

The electrophoretic panel 10 is provided with a pixel array section 30 where four pixels P are lined up and a driving section 40 which drives each of the pixels P under the control of the control circuit 20. The electrophoretic panel 10 according to the embodiment is a static panel where each of the pixels P is independently controlled.

Figure 2:
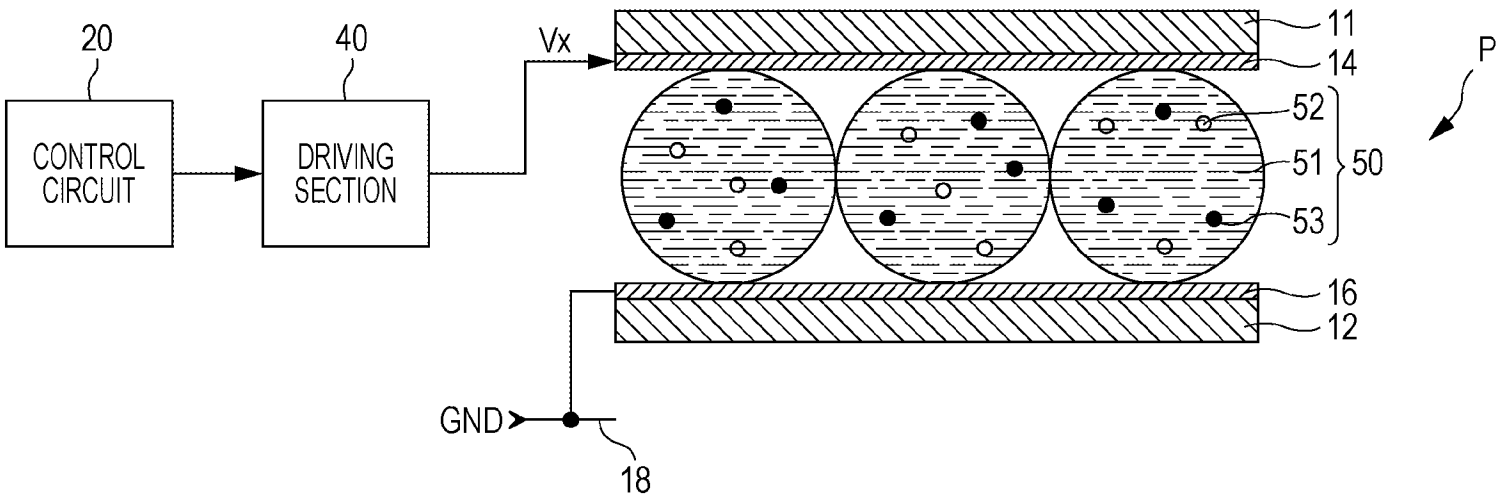
FIG. 2 is a cross-sectional diagram of a pixel according to the first embodiment.

FIG. 2 is a cross-sectional diagram of the pixel P. In FIG. 2, only one of the pixels P is shown in the diagram as a representative and the control circuit 20 and the driving section 40 are rewritten schematically. In the embodiment, there is a configuration where each of the pixels P is arranged between a first substrate 11 and a second substrate 12 which face each other. Specifically, as shown in FIG. 2, the pixel P is configured by a pixel electrode 14 formed on the first substrate 11, an opposing electrode 16 formed on the second substrate 12, and a plurality of microcapsules 50 arranged between the electrodes. A pixel electrode 14 for each of the four pixels P is formed on a surface of the first substrate 11 which faces the second substrate 12, and an opposing electrode 16 which is common to each of the pixels P is formed an opposing surface of the second substrate 12 with regard to the first substrate 11. In the embodiment, since the first substrate 11 is arranged on the viewing side, the first substrate 11 is formed by a transmissive material. On the other hand, since the second substrate 12 is arranged on a side opposite to the viewing side, the second substrate 12 may not be formed by a transmissive material.

Each of the plurality of microcapsules 50 is a spherical body which has a particle diameter of, for example, approximately 50 μm, and a solvent 51 for dispersing electrophoretic particles, a plurality of white particles 52 (electrophoretic particles), and a plurality of black particles 53 (electrophoretic particles) are enclosed therein. The white particles 52 are particles (polymer or colloid) formed from a white pigment such as titanium dioxide, and here, have a negative charge. The black particles 53 are particles (polymer or colloid) formed from a black pigment such as carbon black and here, have a positive charge. In the embodiment, each of the pixels P is configured as an electrophoretic element which includes the pixel electrode 14, the opposing electrode 16, and electrophoretic particles arranged between both electrodes.

As shown in FIG. 2, in the pixel electrode 14, a signal potential Vx is supplied from the driving section 40. According to this, the potential of the pixel electrode 14 is set to the signal potential Vx. On the other hand, since the opposing electrode 16 is connected to an electrical supply line 18 which supplies a ground potential GND (0V), the potential of the opposing electrode 16 is maintained at the ground potential GND.

When a predetermined difference in potential is generated between the pixel electrode 14 and the opposing electrode 16, the electrophoretic particles enclosed in the microcapsules 50 move. In the embodiment, since the pixel electrode 14 side is the viewing side, the color of the electrophoretic particles which have moved to the pixel electrode 14 side are displayed to the viewing side. Below, there is a more detailed description. Here, a case where the pixel P displays black is assumed. In this case, the driving section 40 is controlled so that the control circuit supplies the negative signal potential Vx to the pixel electrode 14. According to this, since the pixel electrode becomes a relatively low potential and the opposing electrode 16 becomes a relatively high potential, the black particles 53 which have a positive charge are drawn to the pixel electrode 14 while the white particles 52 which have a negative charge are drawn to the opposing electrode 16. Accordingly, there is a method in which "black" is visually recognized when the pixel P is seen from the pixel electrode 14 side which is the viewing side.

Next, a case where the pixel P displays white is assumed. In this case, the driving section 40 is controlled so that the control circuit 20 supplies the positive signal potential Vx to the pixel electrode 14. According to this, since the pixel electrode 14 becomes a relatively high potential and the opposing electrode 16 becomes a relatively low potential, the white particles 52 which have a negative charge are drawn to the pixel electrode 14 while the black particles 53 which have a positive charge are drawn to the opposing electrode 16. Accordingly, there is a method in which "white" is visually recognized when the pixel P is seen from the pixel electrode 14 side which is the viewing side. In this manner, it is possible to obtain a desired gradation display by setting the potential (signal potential Vx) of the pixel electrode 14 to a value corresponding to the gradation (brightness) to be displayed and moving the electrophoretic particles.

In addition, since the white particles 52 which have a negative charge and the black particles 53 which have a positive charge are drawn to each other by a Coulomb force and are drawn to the pixel electrode 14 or the opposing electrode 16 by an image force, the electrophoretic particles are not able to be moved unless a voltage which exceeds this absorption force is applied between the pixel electrode 14 and the opposing electrode 16. That is, in a case where the voltage applied between the pixel electrode 14 and the opposing electrode 16 is equal to or less than a predetermined threshold value Vth, there is a property where the electrophoretic particles are not able to be moved and the display state does not change.

In a case where a predetermined voltage which exceeds the threshold value Vth is applied between the pixel electrode 14 and the opposing electrode 16, an electric current flows between the pixel electrode 14 and the opposing electrode 16 due to the movement of the electrophoretic particles. In the embodiment, the electric current is referred to as a first electric current. In addition, since there are a plurality of particles (ions) with charge which are different to the electrophoretic particles in the vicinity of the microcapsules 50 and in the solvent 51, when a difference in potential is generated between the pixel electrode 14 and the opposing electrode 16, ions move and an electric current flows between the pixel electrode 14 and the opposing electrode 16. In the embodiment, an electric current which flows between the pixel electrode 14 and the opposing electrode 16 due to the movement of the ions which are different to the electrophoretic particles is referred to as a second electric current.

That is, in the case where the predetermined voltage which exceeds the threshold value Vth is applied between the pixel electrode 14 and the opposing electrode 16, the first electric current and the second electric current flow between the pixel electrode 14 and the opposing electrode 16 due to the movement of the electrophoretic particles and the ions which are different to the electrophoretic particles. At this time, since the electrophoretic particles (the white particles 52 and the black particles 53) which move toward the electrode of either the pixel electrode 14 and the opposing electrode 16 become a state of being not able to move after having reached the wall surface of the microcapsule 50, even if the predetermined voltage is continuously applied between the pixel electrode 14 and the opposing electrode 16, the first electric current gradually decreases, and ultimately, the electric current value becomes zero. On the other hand, the second electric current continues to flow constantly. Accordingly, in a state where, for example, the changing of the display state to a desired gradation is completed, when the predetermined voltage is continuously applied between the pixel electrode 14 and the opposing electrode 16, there is a method in which only the second electric current continues to flow constantly.

In addition, in the case where the voltage equal to or less than the predetermined threshold value Vth is applied between the pixel electrode 14 and the opposing electrode 16, the electrophoretic particles are not able to be moved and the first electric current does not flow, but due to the movement of the ions which are different to the electrophoretic particles, there is a method in which only the second electric current flows between the pixel electrode 14 and the opposing electrode 16.

Here, it is easy for the ions which are different to the electrophoretic particles to chemically or physically react with the wall surfaces of each of the pixel electrode 14, the opposing electrode 16, and the wall surface of the microcapsules 50, but it is difficult for this reaction to occur since a processing which prevents aggregation and the like is performed on the electrophoretic particles. Accordingly, while burn-in and residual images occur when there is a positive or negative bias in a time integration value of the second electric current, that is when there is a direct current component in the second electric current, even when there is a direct current component in the first electric current, this does not become a cause of burn-in or residual images.

Due to the above, in the embodiment, a configuration is adopted where there is a focus on that (1) image unevenness such as burn-in in the electrophoretic display device is caused by a direct current component in the second electric current (the electric current which flows due to the movement of the ions which are different to the electrophoretic particles) and not by a direct current component in the first electric current (the electric current which flows due to the movement of the electrophoretic particles) and that (2) the display state does not change in the case where the voltage applied between the pixel electrode 14 and the opposing electrode 16 is equal to or less than the threshold value Vth, and a data voltage with a value which corresponds to the gradation specified with regard to the pixel P ("specified gradation") is applied between the pixel electrode 14 and the opposing electrode 16 in a writing period TWR and a correction voltage which is the opposite polarity to the data voltage and is less than or equal to the threshold value Vth is applied between the pixel electrode 14 and the opposing electrode 16 in a correction period TC which is different from the writing period TWR. According to this, it is possible to negate (cancel out) the direct current component of the second electric current without changing the display state. Below, one pixel (electrophoretic element) P will be focused on and the specific operations (driving method) of the pixel P will be described.

Figure 3:
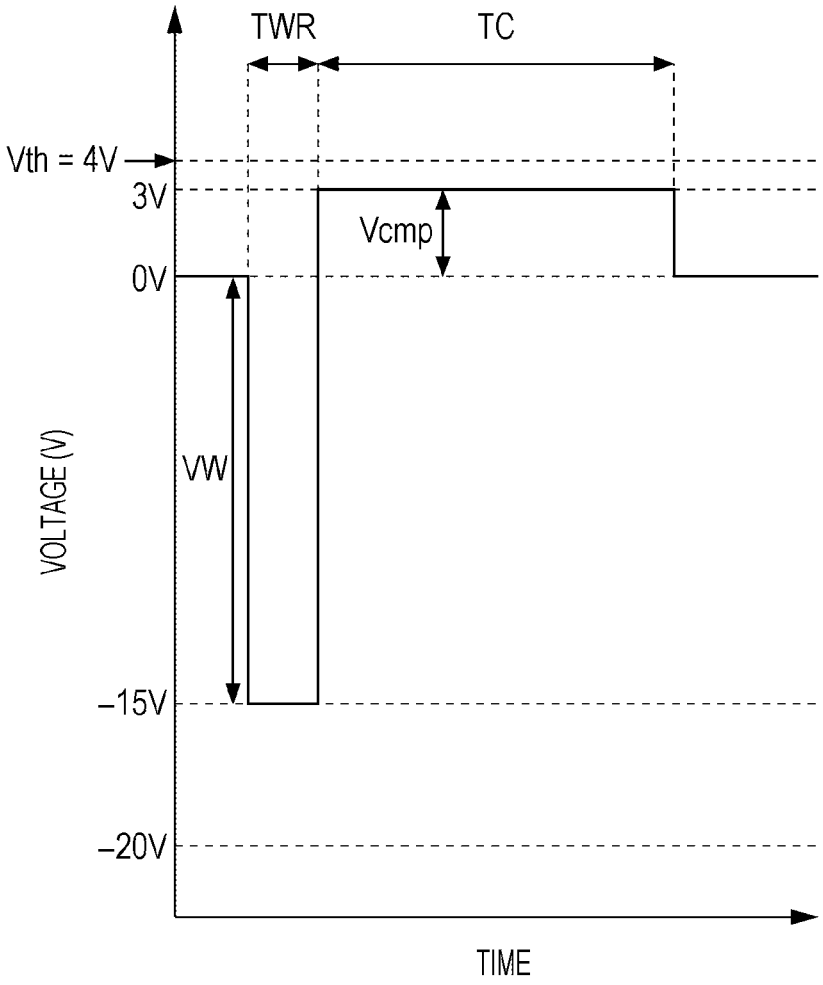
FIG. 3 is a diagram illustrating a specific waveform of a signal potential applied to a pixel.

FIG. 3 is a diagram illustrating a specific waveform of the signal potential Vx applied to the pixel electrode 14 of the one pixel P. In FIG. 3, a case where the pixel P displays black is shown. Below, the operations of the pixel P in the case of FIG. 3 will be described with separation of the writing period TWR and the correction period TC after the writing period TWR.

a1. Writing Period TWR

In the writing period TWR, the control circuit 20 controls the driving section 40 so that a data voltage VW with a value which corresponds to a specified gradation of the pixel P is applied between the pixel electrode 14 and the opposing electrode 16. Here, since the specified gradation of the pixel P is "black", the pixel electrode 14 is set to a relatively low potential and the opposing electrode 16 is set to a relatively high potential, so that the signal potential Vx with a negative value is supplied in the pixel electrode 14. Specifically, in the writing period TWR of FIG. 3, the control circuit 20 controls the driving section 40 so that the signal potential Vx of −15V is supplied with regard to the pixel electrode 14. As described above, since the opposing electrode 16 maintains the ground potential GND (0V), the absolute value of the data voltage VW applied between the pixel electrode 14 and the opposing electrode 16 is set to 15V in the writing period TWR.

In the embodiment, since the predetermined threshold value Vth is set to 4V, the absolute value of the data voltage VW applied between the pixel electrode 14 and the opposing electrode 16 exceeds the threshold value Vth in the writing period TWR. Accordingly, there is a method in which the display state becomes "black" since the black particles 53 which have a positive charge move toward the pixel electrode 14 on the viewing side and the white particles 52 which have a negative charge move toward the opposing electrode 16. In addition, the ions on the positive side which are different to the electrophoretic particles move toward the pixel electrode 14 and the ions on the negative side move toward the opposing electrode 16. Accordingly, in the writing period TWR, the first electric current and the second electric current flow in a direction from the opposing electrode 16 toward the pixel electrode 14. As described above, the first electric current decreases over time while the second electric current continues to flow constantly. If a resistance component in a path where the second electric current flows (electric current path) is written as Ri, the length of time of the writing period TWR is written as tw, and the direction of the electric current from the pixel electrode 14 toward the opposing electrode 16 is positive, the time integration value (total charge amount) of the second electric current which flows between the pixel electrode 14 and the opposing electrode 16 in the writing period TWR is −(15×tw)/Ri.

a2. Correction Period TC

In the correction period TC after the writing period TWR, the control circuit 20 controls the driving section 40 so that a correction voltage Vcmp which is the opposite polarity to the data voltage VW described above and is less than or equal to the predetermined threshold value Vth is applied between the pixel electrode 14 and the opposing electrode 16. Here, that the polarities of voltages are opposite has a meaning that application directions of the voltages are in opposite directions from each other, and if the polarity of the correction voltage Vcmp and the polarity of the data voltage VW are opposite, the direction of the electric charge which flows between the pixel electrode 14 and the opposing electrode 16 when the correction voltage Vcmp is applied between the pixel electrode 14 and the opposing electrode 16 and the direction of the electric charge which flows between the pixel electrode 14 and the opposing electrode 16 when the data voltage VW is applied between the pixel electrode 14 and the opposing electrode 16 are opposite directions from each other.

In the correction period TC of FIG. 3, the control circuit 20 controls the driving section 40 so that the signal potential Vx of +3V is supplied with regard to the pixel electrode 14. According to this, since the absolute value of the correction voltage Vcmp applied between the pixel electrode 14 and the opposing electrode 16 is set at 3V, the correction voltage Vcmp is less than the threshold value Vth. As described above, in the case where the voltage applied between the pixel electrode 14 and the opposing electrode 16 is less than or equal to the predetermined threshold value Vth, since the electrophoretic particles are not able to be moved, the first electric current does not flow and the display state remains as "black". On the other hand, since the ions on the negative side which are different from the electrophoretic particles move toward the pixel electrode 14 and the ions on the positive side move toward the opposing electrode 16, the second electric current flows in a direction from the pixel electrode 14 to the opposing electrode 16. That is, the direction of the second electric current in the correction period TC and the direction of the second electric current in the writing period TWR are opposite directions from each other. If the length of time of the correction period TC is written as tcmp, the time integration value (total charge amount) of the second electric current which flows between the pixel electrode 14 and the opposing electrode 16 in the correction period TC is (3×tcmp)/Ri.

In the embodiment, the control circuit 20 controls the electrophoretic panel 10 so that the absolute value of the time integration value of the second electric current in the writing period TWR and the absolute value of the time integration value of the second electric current in the correction period TC are equal. In the case of FIG. 3, there is a method where each of the voltages (the data voltage VW and the correction voltage Vcmp) and times (the length of time tw and the length of time tcmp) are set so that (15×tw)/Ri=(3×tcmp)/Ri. Accordingly, in regard to the total time of the writing period TWR and the correction period TC, there is no direct current component of the second electric current since the total charge amount which flows into the resistance component Ri is −(15×tw)/Ri+(3×tcmp)/Ri=0. According to this, it is possible to prevent the generation of image unevenness such as burn-in or residual images. Furthermore, in the embodiment, the display state does not change in the correction period TC since the value of the correction voltage Vcmp applied between the pixel electrode 14 and the opposing electrode 16 in the correction period TC is set to be equal to or less than the threshold value Vth. According to this, image flickering is not generated and display quality is excellent. Due to the above, according to the embodiment, there are advantages in that image flickering is not displayed and it is possible to prevent image unevenness such as burn-in.

B: Second Embodiment

Next, a second embodiment of the invention will be described. Here, in regard to the elements where the actions and functions are the same as the first embodiment in the second embodiment will be given the same reference numerals as the first embodiment and the detailed description of each will not be included where appropriate. An electrophoretic display device 200 according to the second embodiment is an active matrix-type panel which is different to the first embodiment described above.

Figure 4:
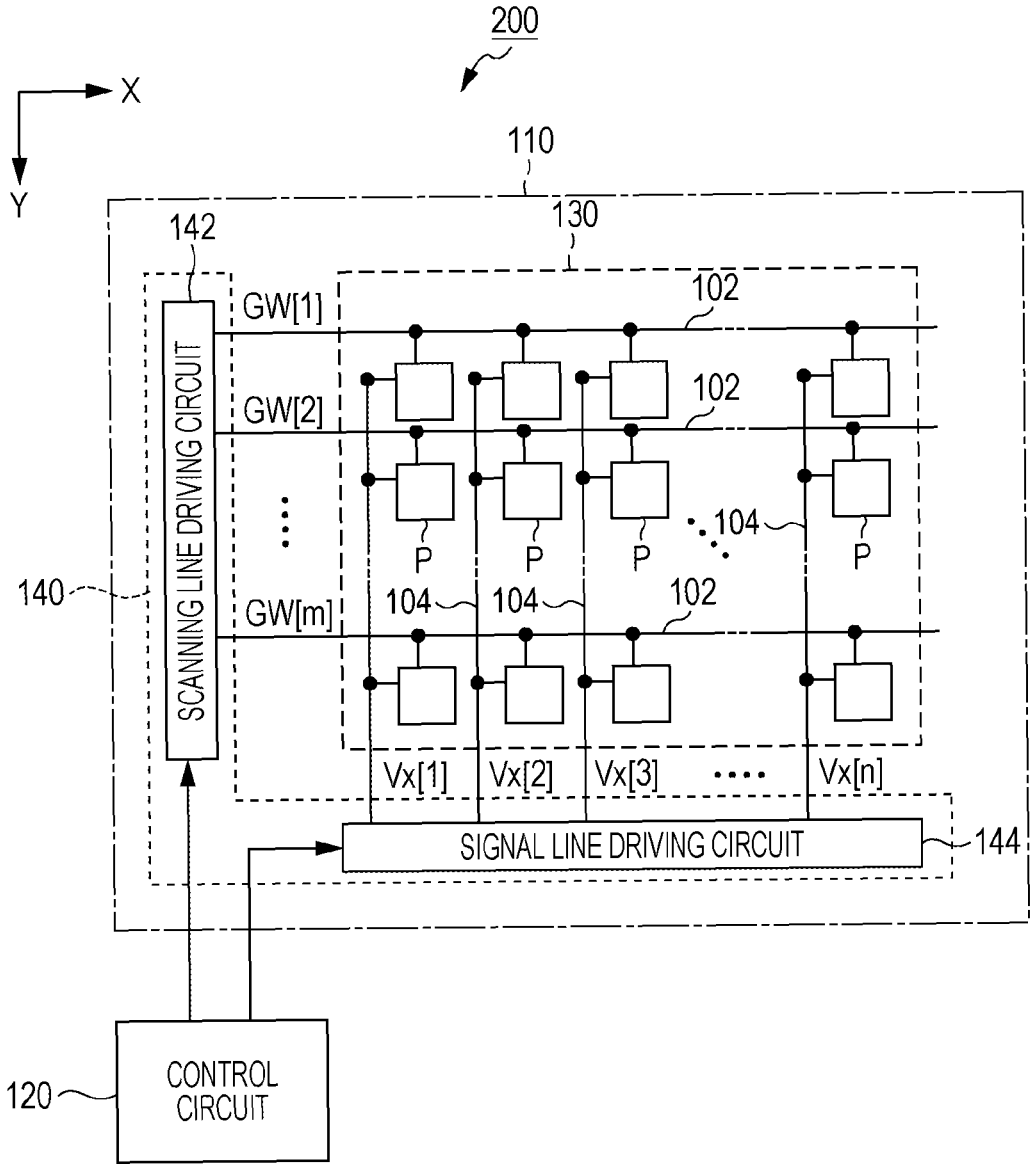
FIG. 4 is a block diagram illustrating an outline configuration of an electrophoretic display device according to a second embodiment of the invention.

FIG. 4 is a block diagram illustrating an outline configuration of the electrophoretic display device 200 according to the embodiment. As shown in FIG. 4, the electrophoretic display device 200 is provided with an electrophoretic panel 110 and a control circuit 120. The electrophoretic panel 110 is provided with a pixel array section 130 where a plurality of pixels P are lined up in a matrix formation and a driving section 140 which drives each of the pixels P. In the embodiment, the driving section 140 is configured to include a scanning line driving circuit 142 and a signal line driving circuit 144. The control circuit 120 comprehensively controls the scanning line driving circuit 142 and the signal line driving circuit 144 based on image data and synchronization signals supplied from a high-level device.

In the pixel array section 130, m scanning lines 102 which extend in an X direction and n signal lines 104 which extend in a Y direction are formed (where m and n are natural numbers). The plurality of pixels P are arranged at intersections of the scanning lines 102 and the signal lines 104 and are lined up in a column and row formation of m rows in a vertical direction×n columns in a horizontal direction. The scanning line driving circuit 142 outputs scanning signals GW [1] to GW [m] to each of the scanning lines 102. Here, the scanning signal which is output to the $i^{th}$ row ($1 \leq i \leq m$) of the scanning lines 102 is written as GW [i]. In addition, the signal line driving circuit 144 outputs scanning signals Vx [1] to Vx [n] to each of the signal lines 104. Here, the scanning signal which is output to the $j^{th}$ column ($1 \leq j \leq n$) of the signal lines 104 is written as Vx [j]

Figure 5:
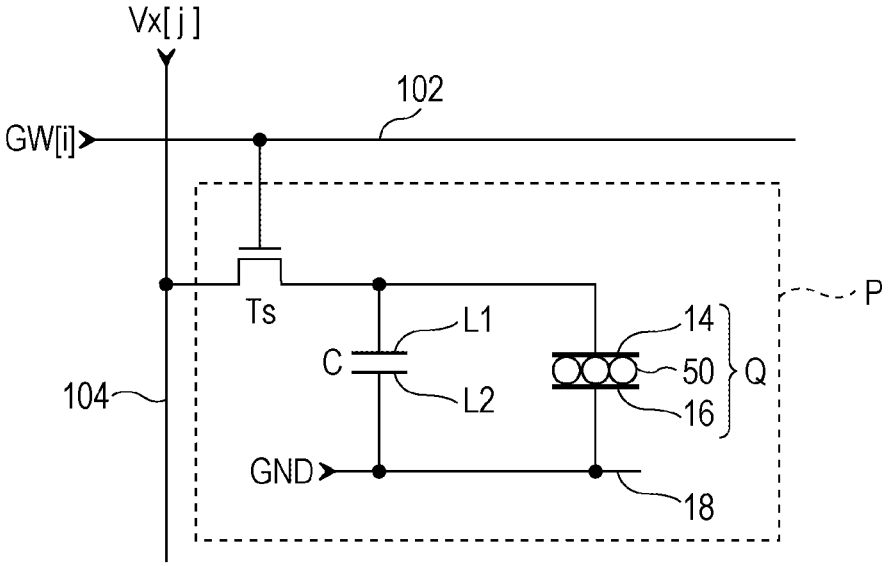
FIG. 5 is a circuit diagram of a pixel according to the second embodiment.

FIG. 5 is a circuit diagram of the pixel P. In FIG. 5, only one pixel P which is positioned on the $j^{th}$ column of the $i^{th}$ row is shown in the diagram as a representative. As shown in FIG. 5, the pixel P is configured to include an electrophoretic element Q, a selection switch Ts, and a holding capacitance C. The electrophoretic element Q is configured by the pixel electrode 14 and the opposing electrode 16 which are facing with an opening of a gap and the plurality of microcapsules arranged between the electrodes. Since the opposing electrode 16 is connected to an electrical supply line 18 which supplies a ground potential GND (0V), the potential of the opposing electrode 16 is maintained at the ground potential GND.

Here, in FIG. 5, the diagrammatic representation of the first substrate 11 and the second substrate 12 are not included, but in the same manner as the first embodiment, there is a configuration where each of the pixels P is arranged between the first substrate 11 and the second substrate 12 which face each other. However, in the embodiment, since the second substrate 12 is arranged on the viewing side, the second substrate 12 is formed by a transmissive material. On the other hand, since the first substrate 11 is arranged on a side opposite to the viewing side, the first substrate 11 may not be formed by a transmissive material.

In the embodiment, since the opposing electrode 16 side is the viewing side, in the case where the pixel electrode 14 is a relatively low potential and the opposing electrode 16 is a relatively high potential, the black particles 53 which have a positive charge are drawn to the pixel electrode 14 and the white particles 52 which have a negative charge are drawn to the opposing electrode 16. According to this, "white" is visually recognized when the pixel P is seen from the opposing electrode 16 side which is the viewing side. On the other hand, in the case where the pixel electrode 14 is a relatively high potential and the opposing electrode 16 is a relatively low potential, since the white particles 52 which have a negative charge are drawn to the pixel electrode 14 and the black particles 53 which have a positive charge are drawn to the opposing electrode 16, there is a method in which "black" is visually recognized when the pixel P is seen from the opposing electrode 16 side which is the viewing side.

The selection switch Ts is interposed between the pixel electrode 14 and the signal line 104 and controls the electric connection (conduction/non-conduction) of the pixel electrode 14 and the signal line 104. As shown in FIG. 5, for example, an N channel type transistor (for example, a thin film transistor) is appropriately adopted as the selection switch Ts. The gates of each of the selection switches Ts of the n pixels P which belong to the $i^{th}$ row is connected in common with regard to the $i^{th}$ row of the scanning lines 102.

As shown in FIG. 5, the holding capacitance C has a first electrode L1 and a second electrode L2. The first electrode L1 is connected to one of the electrodes (drain or source) of the pixel electrode 14 and the selection switch Ts and the second electrode L2 is connected to the electrical supply line 18.

Figure 6:
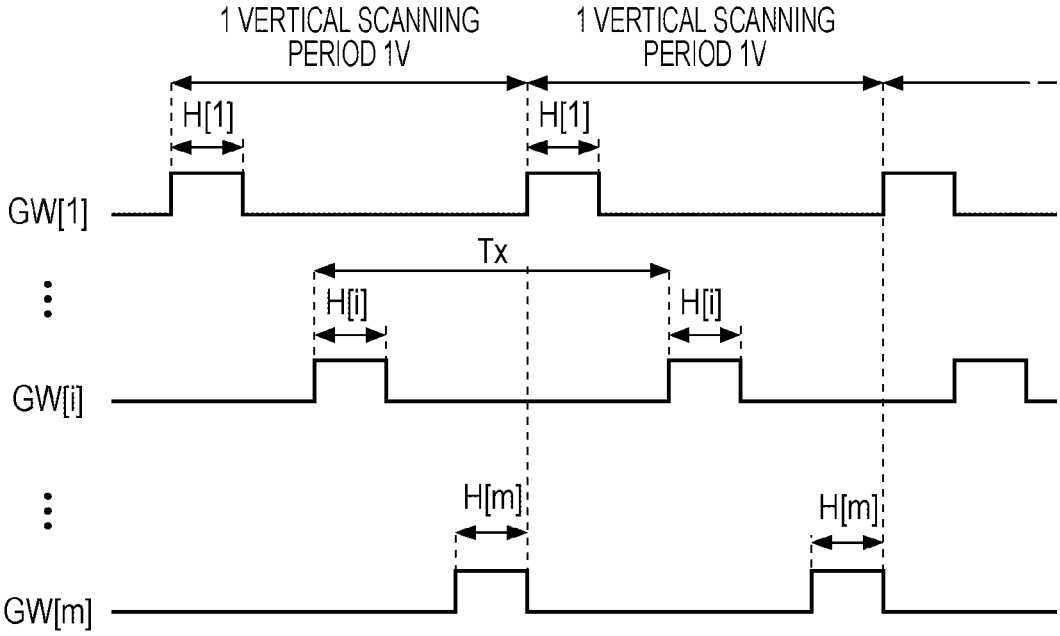
FIG. 6 is a diagram illustrating a specific waveform of a signal generated by a scanning line driving circuit.

Next, each of the signals which are generated by the driving circuit 140 will be described while referring to FIG. 6. As shown in FIG. 6, each of the scanning lines 102 are sequentially selected by the scanning line driving circuit 142 setting the scanning signals GW [1] to GW [m] to an active level (high level) in order in each of m horizontal scanning periods H (H [1] to H [m]) in each vertical scanning period 1V. The transfer of the scanning signal GW [i] to a high level has a meaning of selecting the $i^{th}$ row of the scanning lines 102. When the scanning signal GW [i] is transferred to a high level, each of the selection switches Ts of the n pixels P which belong to the $i^{th}$ row are changed at once to an on state.

In addition, the signal line driving circuit 144 generates the signal potentials Vx [1] to Vx [n] which correspond to one row of (n) pixels P which is selected by the scanning line driving circuit 142 in each of the horizontal scanning periods H and outputs the signal potentials Vx [1] to Vx [n] to each of the signal lines 104. For example, in the $i^{th}$ horizontal scanning period H [i] in each of the vertical scanning periods 1V, in the $j^{th}$ column of the signal lines 104, a data potential VD [i,j] which corresponds to the specified gradation of the electrophoretic element Q of the pixel P which is positioned on the $j^{th}$ column of the $i^{th}$ row or a predetermined correction potential VC [i,j] is output as the signal potential Vx [j]. Detailed content will be described later.

Figure 7:
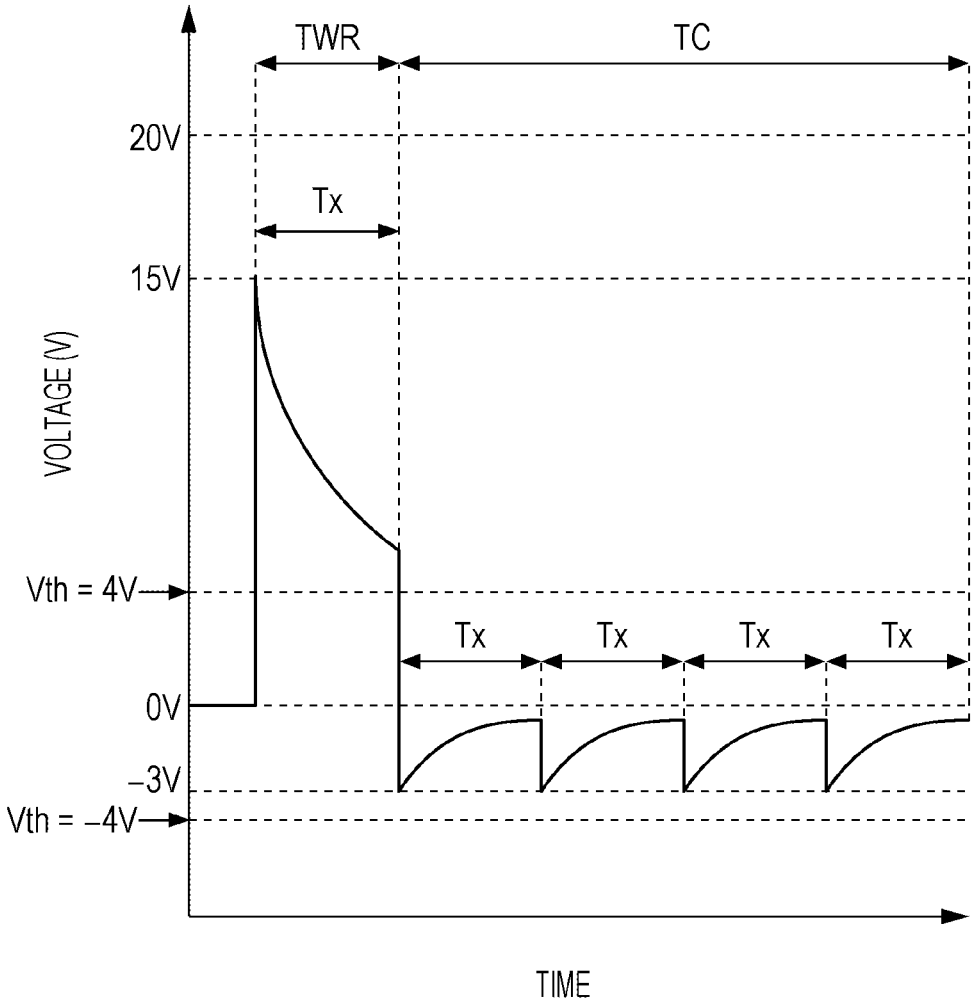
FIG. 7 is a diagram illustrating a specific waveform of a voltage held in a holding capacitance of a pixel.

Here, the pixel P which is positioned on the $j^{th}$ column of the $i^{th}$ row will be focused on and the specific operations (driving method) of the pixel P will be described. FIG. 7 is a diagram illustrating a specific waveform of a voltage held in the holding capacitance C of the pixel P. In FIG. 7, the case where the pixel P displays black is shown. Below, there is separation of the writing period TWR where the data potential VD [i,j] which corresponds to the specified gradation of pixel P is written into the pixel P and the correction period TC which is a period after the writing period TWR and where the predetermined correction potential VC [i,j] is written into the pixel P, and the operations of the pixel P in the case of FIG. 7 will be described.

b1. Writing Period TWR

In the writing period TWR, the control circuit 120 controls the driving section 140 so that a data voltage with a value which corresponds to the specified gradation of the pixel P is applied between the pixel electrode 14 and the opposing electrode 16. Specifically, the control circuit 120 controls the driving section 140 (the scanning line driving circuit 142 and the signal line driving circuit 144) so as to execute an operation (referred to below as a "data writing operation") where the data potential VD [i,j] with a size which corresponds to the specified gradation of the pixel P which is positioned on the $j^{th}$ column of the $i^{th}$ row is output to the $j^{th}$ column of the signal lines 104 in synchronization with the timing when the $i^{th}$ row of the scanning lines 102 is selected. As will be described later, the number of times the data writing operation is performed is variably set in correspondence with the specified gradation of the pixel P, but in the state of FIG. 7, the number of times the data writing operation is performed is set to one. In the embodiment, since the period from when the $i^{th}$ row of the scanning lines 102 is selected to when the $i^{th}$ row of the scanning lines 102 is selected again is referred to as the unit period Tx (refer to FIG. 6), there is a method in which the writing period TWR is configured as one unit period Tx in the state of FIG. 7.

Below, the detailed content of the data writing operation executed in the writing period TWR shown in FIG. 7 will be described. Here, the pixel electrode 14 is set to a relatively high potential and the opposing electrode 16 is set to a relatively low potential since the specified gradation of the pixel P which is positioned on the $j^{th}$ column of the $i^{th}$ row is "black", so that the data potential VD [i,j] output to the $j^{th}$ column of the signal lines 104 is set as a positive value. Specifically, the control circuit 120 controls the driving section 140 (the scanning line driving circuit 142 and the signal line driving circuit 144) so that the data potential VD [i,j] of +15V is output to the $j^{th}$ column of the signal lines 104 as the signal potential Vx [j] in synchronization with the timing when the $i^{th}$ row of the scanning lines 102 is selected. Since each of the selection switches Ts of the n pixels P which belong to the $i^{th}$ row become an on state at once when the $i^{th}$ row of the scanning lines 102 is selected, the signal line 104 of the $j^{th}$ column conducts with the pixel electrode 14 of the pixel P and the first electrode L1 of the holding capacitance C via the selection switches Ts in the on state. According to this, the data potential VD [i,j] of +15V is supplied (written) in the pixel electrode 14 of the pixel P and the holding capacitance C, and the pixel electrode 14 becomes a relatively high potential and the opposing electrode 16 becomes a relatively low potential. As described above, since the opposing electrode 16 is maintained at the ground potential GND (0V), the absolute value of the voltage applied between the pixel electrode 14 and the opposing electrode 16 at that time becomes 15V (>threshold value Vth=4V). In addition, at that time, the voltage between both terminals of the holding capacitance C (the voltage between the first electrode L1 and the second electrode L2) is also set to 15V.

Each of the selection switches Is of the n pixels P which belong to the $i^{th}$ row become an off state at once when the selection of the $i^{th}$ row of the scanning lines 102 is completed, but the movement of the electrophoretic particles continues as long as the voltage which is held in the holding capacitance C of the pixel P in the $j^{th}$ column of the $i^{th}$ row exceeds the predetermined threshold value Vth (=4V). However, since static energy of the holding capacitance C is used in the movement of the electrophoretic particles and the ions which are different from the electrophoretic particles, the electric charge accumulated in the holding capacitance C gradually decreases. Accordingly, as shown in FIG. 7, the voltage between both terminals of the holding capacitance C gradually decreases.

In the state of FIG. 7, it is sufficient if the number of times the data writing operation is performed one time since the changing of the desired gradation (black) of the pixel P which is positioned on the $j^{th}$ column of the $i^{th}$ row is completed before the voltage between both terminals of the holding capacitance C becomes less than or equal to the threshold value Vth. However, depending on the specified gradation of the pixel P, that is the value of the data potential VD [i,j], there are cases where the voltage of the holding capacitance C becomes less than or equal to the threshold value Vth before the changing of the desired gradation of the pixel P is completed. In the case such as this, since the desired gradation display cannot be performed, the control circuit 120 controls the driving section 140 so as to perform the data writing operation again. That is, the number of times the data writing operation is performed is variably set in correspondence with the specified gradation of the pixel P. In addition, the length of time of the writing period TWR is a length which corresponds to the number of times the data writing operation is performed. For example, in a case where it is required that the data writing operation is performed twice, the writing period TWR is set as a period where two unit periods Tx are combined. In other words, there is a method in which the writing TWR in this case is configured by two unit periods Tx.

Figure 8:
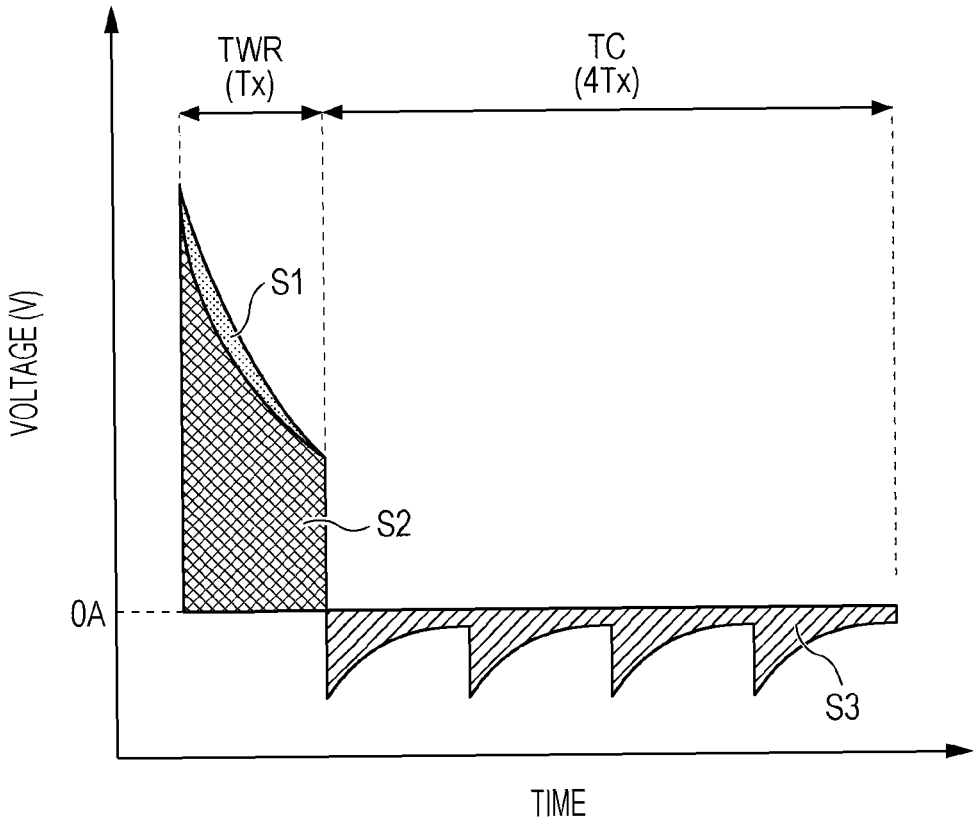
FIG. 8 is a diagram illustrating a relationship between an electric current which flows between a pixel electrode and an opposing electrode and time.

As described above, in the state of FIG. 7, since the voltage between both terminals of the holding capacitance C exceeds the threshold value Vth over the writing period TWR, and since the pixel electrode 14 becomes a relatively high potential and the opposing electrode 16 becomes a relatively low potential, the black particles 53 which have a positive charge move to the opposing electrode 16 side which is the viewing side and the white particles 52 which have a negative charge move to the pixel electrode 14 side. In addition, the ions on the positive side which are different from the electrophoretic particles move toward the opposing electrode 16 and the ions on the negative side move towards the pixel electrode 14. Accordingly, in the writing period TWR, the first electric current and the second electric current flow in a direction from the pixel electrode 14 to the opposing electrode 16. In the embodiment, the direction of the electric current from the pixel electrode 14 toward the opposing electrode 16 is positive. FIG. 8 is a diagram illustrating a relationship between the electric current which flows between the pixel electrode 14 of the pixel P which is positioned on the $j^{th}$ column of the $i^{th}$ row and the opposing electrode 16 and time. The absolute value of the time integration value of the first electric current in the writing period TWR of FIG. 7 is equivalent to an area value of a region S1 shown in FIG. 8, and the absolute value of the time integration value of the second electric current is equivalent to an area value of a region S2 shown in FIG. 8.

b2. Correction Period TC

In the correction period TC after the writing period TWR described above, the control circuit 120 controls the driving section 140 so that the correction voltage which is the opposite polarity to the data voltage and is less than or equal to the predetermined threshold value Vth is applied between the pixel electrode 14 and the opposing electrode 16. Specifically, the control circuit 120 controls the driving section 140 (the scanning line driving circuit 142 and the signal line driving circuit 144) so as to execute an operation (referred to below as a "correction operation") where the correction potential VC [i,j] with a polarity opposite to the data potential VD [i,j] is output to the $j^{th}$ column of the signal lines 104 as the signal potential Vx [j] in synchronization with the timing when the $i^{th}$ row of the scanning lines 102 is selected. In the embodiment, the control circuit 120 controls the driving section 140 so that the absolute value of the time integration value of the second electric current in the writing period TWR and the absolute value of the time integration value of the second electric current in the correction period TC are equal. That is, the value of the correction potential VC [i,j] and the number of times the correction operation is performed (that is, the length of time of the correction period TC) is set to a value so that the absolute value of the time integration value of the second electric current in the writing period TWR and the absolute value of the time integration value of the second electric current in the correction period TC are equal. In the state of FIG. 7, the value of the correction potential VC [i,j] is set as −3V. In addition, in the state of FIG. 7, since the number of times the correction operation is performed is set to four, the correction period TC is a period where four unit periods Tx are combined. In other words, there is a method in which the correction period TC is configured by four unit periods Tx.

Below, detailed content on the correction operation which is executed in the correction period TC shown in FIG. 7 will be described. The control circuit 120 controls the driving section 140 (the scanning line driving circuit 142 and the signal line driving circuit 144) so that the correction potential VC [i,j] of −3V is output to the $j^{th}$ column of the signal lines 104 as the signal potential Vx [j] in synchronization with the timing when the $i^{th}$ row of the scanning lines is selected. According to this, the correction potential VC [i,j] of −3V is supplied (written) in the pixel electrode 14 of the pixel P which is positioned on the $j^{th}$ column of the $i^{th}$ row and the first electrode L1 of the holding capacitance C, and the pixel electrode 14 becomes a relatively low potential and the opposing electrode 16 becomes a relatively high potential. As described above, since the opposing electrode 16 maintains the ground potential GND (0V), the absolute value of the voltage applied at that time between the pixel electrode 14 and the opposing electrode 16 becomes 3V (<threshold value Vth=4V) and the electrophoretic particles are not able to be moved. Accordingly, the first electric current does not flow and the display state remains as "black". On the other hand, since the ions on the positive side which are different from the electrophoretic particles move toward the pixel electrode 14 and the ions on the negative side move toward the opposing electrode 16, the second electric current flows in a direction from the opposing electrode 16 to the pixel electrode 14 (direction opposite to the writing period TWR). In addition, the voltage between both terminals of the holding capacitance C is also set to 3V.

Each of the selection switches Is of the n pixels P which belong to the $i^{th}$ row become an on state at once when the selection of the $i^{th}$ row of the scanning lines 102 is completed, but the movement of the ions described above continues due to the voltage held in the holding capacitance C of the pixel P which is positioned on the $j^{th}$ column of the $i^{th}$ row. However, since static energy of the holding capacitance C is used in the movement of the ions, the electric charge accumulated in the holding capacitance C gradually decreases. Accordingly, the voltage between both terminals of the holding capacitance C gradually decreases and the absolute value of the second electric current also gradually decreases. After that, there is a method where the holding capacitance C is again charged with the correction potential VC [i,j] of −3V at a timing when the next correction operation is performed and the operation described above is repeated. The absolute value of the time integration value of the second electric current in the correction period TC described above is equivalent to an area value of a region S3 shown in FIG. 8.

In the embodiment, since the control circuit 120 controls the driving section 140 so that the area value of the region S2 shown in FIG. 8 (the absolute value of the time integration value of the second electric current in the writing period TWR) and the area value of the region S3 (the absolute value of the time integration value of the second electric current in the correction period TC), the direct current component of the second electric current is negated and becomes zero in the same manner as the first embodiment. Accordingly, it is possible to prevent the generation of image unevenness such as burn-in and residual images. In addition, in the embodiment, since the value of the voltage applied between the pixel electrode 14 and the opposing electrode 16 in the correction period TC is set to be equal to or less than the threshold value Vth, the display state does not change in the correction period TC. According to this, image flickering is not generated and there is excellent display quality. Accordingly, even in the second embodiment, there are advantages in that image flickering is not displayed and it is possible to prevent image unevenness such as burn-in.

C: MODIFIED EXAMPLES

The invention is not limited to the embodiments described above, and for example, the modifications below are possible. In addition, it is possible for two or more of the modified examples out of the modified example shown below to be combined.

1. Modified Example 1

Figure 9:
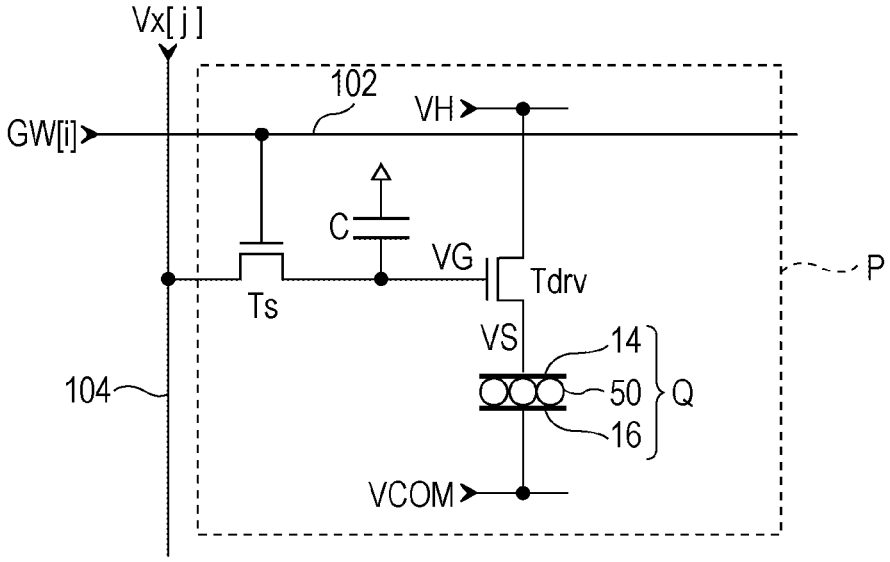
FIG. 9 is a circuit diagram of a pixel according to a modified example of the invention.
Figure 10:
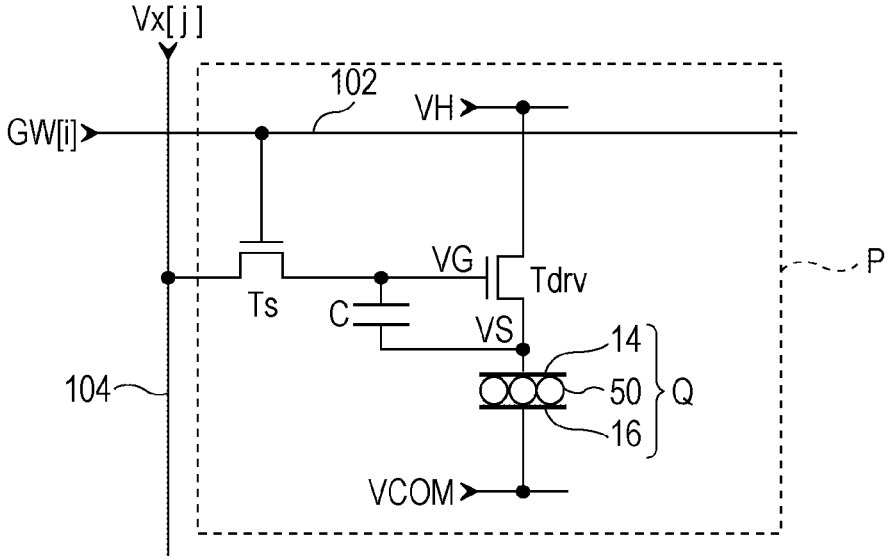
FIG. 10 is a circuit diagram of a pixel according to a modified example of the invention.

In the second embodiment described above, the configuration of the pixel P shown in FIG. 5 is shown as an example, but the configuration of the pixel P is not limited to this and may be arbitrary. In other words, it is sufficient if the pixel P includes the electrophoretic element which includes the pixel electrode 14, the opposing electrode 16, and the charged particles (electrophoretic particles) arranged between the electrodes. For example, as shown in FIG. 9, it is possible to adopt a constant voltage driving pixel P where a potential VG of a gate of a driving transistor Tdry is constant with regard to the potential Vcom of the opposing electrode 16. In addition, for example, as shown in FIG. 10, it is possible to adopt a constant electric current driving pixel P where a potential VG of a gate of a driving transistor Tdry is constant with regard to a potential VS of a source of the driving transistor Tdrv. In addition, for convenience of description, in FIGS. 9 and 10, the diagrammatic representation of a circuit for correcting variation in the threshold value voltage and the amount of movement of the driving transistor Tdry is not included. In addition, in FIG. 10, the diagrammatic representation is not included also in regard to a circuit for applying a predetermined voltage to the holding capacitance C.

In other words, even in a configuration which includes any type of the pixel P which includes the electrophoretic particles, it is possible to negate the direct current component of the second electric current (the electric current which flows between the pixel electrode 14 and the opposing electrode 16 due to the movement of the ions which are different to the electrophoretic particles) which becomes a cause of image unevenness without changing the display state due to the data voltage with a value which corresponds to the specified gradation of the electrophoretic element in the writing period being applied between the pixel electrode 14 and the opposing electrode 16 and the correction voltage which is the opposite polarity to the data voltage and is less than or equal to the predetermined threshold value Vth being applied between the pixel electrode 14 and the opposing electrode 16 in the correction period which is different from the writing period.

2. Modified Example 2

In each of the embodiments described above, a state where the absolute value of the time integration value of the second electric current in the writing period TWR and the absolute value of the time integration value of the second electric current in the correction period TC are equal is shown as an example, but is not limited to this, and there may be a state where the absolute value of the time integration value of the second electric current in the writing period TWR and the absolute value of the time integration value of the second electric current in the correction period TC are different. Even in this state, if the voltage applied between the pixel electrode 14 and the opposing electrode 16 in the correction period TC is equal to or less than the predetermined threshold value Vth, since the electrophoretic particles are not able to be moved and the display state does not change, it is possible to prevent the display of image flickering.

3. Modified Example 3

In each of the embodiments described above, the correction period TC is set to be after the writing period TWR, but is not limited to this, and for example, the correction period TC may be set to be before the writing period TWR. In other words, it is sufficient if the correction voltage which is the opposite polarity to the data voltage (the voltage with a size which corresponds to the specified gradation of the pixel P) which is written in the pixel P in the writing period TWR and is less than or equal to the predetermined threshold value Vth is applied between the pixel electrode 14 and the opposing electrode 16 in the correction period TC which is different to the writing period TWR.

4. Modified Example 4

In each of the embodiments described above, the electrophoretic particles (charged particles) arranged between the pixel electrode 14 and the opposing electrode 16 are configured by the white particles 52 which have a negative charge and the black particles 53 which have a positive charge, but there may be a state where, for example, the white particles 52 have a positive charge and the black particles 53 have a negative charge. In addition, it is possible for particles formed from, for example, pigments with a red color, a green color, a blue color, or the like to be used as the electrophoretic particles instead of the white particles 52 and the black particles 53.

In addition, there may be a state where monochromatic particles are dispersed in the colored solvent 51. For example, the white particles 52 may be dispersed in the solvent 51 which is colored black or the black particles 53 may be dispersed in a solvent 51 which is colored white. Furthermore, particles with three colors or more may be dispersed in the solvent 51.

5. Modified Example 5

In each of the embodiments described above, a state where the microcapsules 50 which enclose the charged particles (electrophoretic particles) are arranged between the pixel electrode 14 and the opposing electrode 16 is shown as an example, but is not limited to this, and there may be a state where a partition wall (separator) for separating each of the pixels P in a space between the first substrate 11 and the second substrate 12 and the charged particles are directly enclosed in each space separated by the partition wall.

6. Modified Example 6

In the first embodiment described above, four pixels P are arranged in the pixel array section 30, but is not limited to this, and it is possible to arbitrarily set the number of pixels P arranged in the pixel array section 30.

D: Applied Example

Next, an electronic apparatus which uses the electrophoretic display device (100, 200) according to each of the embodiments described above will be described.

Figure 11:
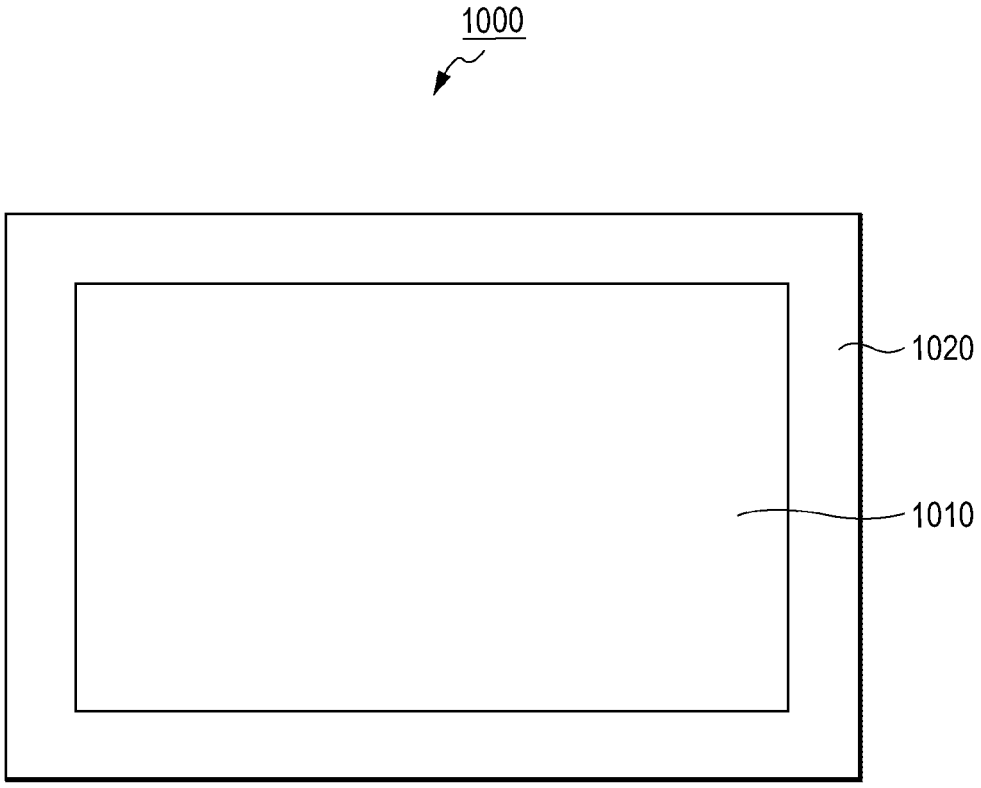
FIG. 11 is a diagram illustrating a specific form of an electronic apparatus according to the invention.

FIG. 11 is a diagram illustrating a configuration of an electronic paper 1000 which uses the electrophoretic display device (100, 200) according to each of the embodiments described above. In the electronic paper 1000, the electrophoretic display device (100, 200) described above is provided at a display region 1010. The electronic paper 1000 is configured to be provided with a body section 1020 formed from a rewriteable sheet having the same feeling and flexibility as existing paper. In the electronic paper 1000, it is possible for excellent display quality to be secured since the electrophoretic display device according to the invention is adopted.

In addition, as the electronic apparatus, where the electrophoretic display device according to the invention is applied is not limited to the electronic paper 1000 shown in FIG. 11 and it is possible to applied the electrophoretic display device according to the invention to various electronic apparatuses. For example, as the electronic apparatus to which the electrophoretic display device according to the invention is applied, there are electronic notebooks, wrist watches, mobile phones, portable audio devices, and the like.

What is claimed is:

1. An electrophoretic display device comprising:

an electrophoretic panel which is provided with an electrophoretic element which includes a first electrode, a second electrode which faces the first electrode, particle arranged between the first electrode and the second electrode, and an ion different from the electrophoretic particle arranged between the first electrode and the second electrode, wherein the electrophoretic particle moves at an applied voltage greater than that of the ion; and a control circuit which controls the electrophoretic panel, wherein the control circuit controls a data voltage with a value which corresponds to a specified gradation of the electrophoretic element to be applied between the first electrode and the second electrode in a writing period, the control circuit controls a correction voltage which is the opposite polarity to the data voltage and is less than or equal to a predetermined threshold value to be applied between the first electrode and the second electrode in a correction period which is different from the writing period, and the control circuit controls a first absolute value of a first time integration value of a first electric current, the first electric current flows between the first electrode and the second electrode due to movement of the ion during the writing period, a second absolute value of a second time integration value of a second electric current, the second electric current flows between the first electrode and the second electrode due to movement of the ion during the correction period, and the first absolute value of the first time integration value of the first electric current is equal to the second absolute value of the second time integration value of the second electric current.

2. An electronic apparatus comprising:

the electrophoretic display device according to claim 1.

3. A control circuit, which controls an electrophoretic panel, which is provided with an electrophoretic element which has a first electrode, a second electrode which faces the first electrode, and an electrophoretic particle and an ion different from the electrophoretic particle are arranged between the first electrode and the second electrode, wherein a data voltage with a value which corresponds to a specified gradation of the electrophoretic element is controlled to be applied between the first electrode and the second electrode in a writing period, a correction voltage which is the opposite polarity to the data voltage and is less than or equal to a predetermined threshold value is controlled to be applied between the first electrode and the second electrode in a correction period after the writing period, and a first absolute value of a first time integration value of a first electric current is controlled to be equal to a second absolute value of a second time integration value of a second electric current, the first electric current flows between the first electrode and the second electrode due to movement of the ion during the writing period, and the second electric current flows between the first electrode and the second electrode due to movement of the ion during the correction period.

4. A driving method of an electrophoretic element, which has a first electrode, a second electrode which faces the first electrode, and an electrophoretic particle and an ion different from the electrophoretic particle are arranged between the first electrode and the second electrode, the driving method comprising:

applying a data voltage with a value which corresponds to the specified gradation of the electrophoretic element between the first electrode and the second electrode in a writing period;

applying a correction voltage which is the opposite polarity to the data voltage and is less than or equal to a predetermined threshold value between the first electrode and the second electrode in a correction period after the writing period; and controlling a first absolute value of a first time integration value of a first electric current to be equal to a second absolute value of a second time integration value of a second electric current, wherein the first electric current flows between the first electrode and the second electrode due to movement of the ion during the writing period, and the second electric current flows between the first electrode and the second electrode due to movement of the ion during the correction period.

* * * * *